US009647381B2

(12) United States Patent
Head

(10) Patent No.: US 9,647,381 B2
(45) **Date of Patent: *May 9, 2017**

(54) DOWNHOLE ELECTRICAL WET CONNECTOR

(71) Applicant: AccessESP UK Limited, Surrey (GB)

(72) Inventor: Philip Head, Egham (GB)

(73) Assignee: ACCESSESP UK LIMITED (GB)

( * ) Notice: Subject to any disclaimer, the term of this patent is extended or adjusted under 35 U.S.C. 154(b) by 0 days.

This patent is subject to a terminal disclaimer.

(21) Appl. No.: 14/683,389

(22) Filed: Apr. 10, 2015

(65) Prior Publication Data

US 2016/0211606 A1 Jul. 21, 2016

Related U.S. Application Data

(63) Continuation of application No. 13/897,481, filed on May 20, 2013, now Pat. No. 9,028,264.

(30) Foreign Application Priority Data

Jul. 24, 2012 (GB) ..... 1213164.5

(51) Int. Cl.

| | |
|---|---|
| ***H01R 4/64*** | (2006.01) |
| ***H01R 13/52*** | (2006.01) |
| ***H01R 13/00*** | (2006.01) |
| ***E21B 17/02*** | (2006.01) |
| ***H01R 13/523*** | (2006.01) |

(52) U.S. Cl.

CPC ..... *H01R 13/5219* (2013.01); *E21B 17/028* (2013.01); *H01R 13/00* (2013.01); *H01R 13/523* (2013.01)

(58) Field of Classification Search

CPC ..... H01R 13/00; H01R 13/523
USPC ..... 439/140, 141, 190, 191, 194, 199, 201
See application file for complete search history.

(56) References Cited

U.S. PATENT DOCUMENTS

| | | | |
|---|---|---|---|
| 3,491,326 | A | 1/1970 | Pfister et al. |
| 3,508,188 | A | 4/1970 | Buck |
| 3,641,479 | A | 2/1972 | O'Brien et al. |
| 3,729,699 | A | 4/1973 | Briggs et al. |
| 3,839,608 | A | 10/1974 | DeVries |
| 3,845,450 | A | 10/1974 | Cole et al. |
| 4,080,025 | A | 3/1978 | Garnier et al. |

(Continued)

FOREIGN PATENT DOCUMENTS

| | | |
|---|---|---|
| GB | 2477214 A | 7/2011 |
| WO | WO 9115882 | 10/1991 |
| WO | WO 2010122342 A1 | 10/2010 |

OTHER PUBLICATIONS

British Search Report, Application No. GB1213164.5, dated Sep. 25, 2012.

*Primary Examiner* — Neil Abrams
(74) *Attorney, Agent, or Firm* — Gordon G. Waggett, P.C.

(57) ABSTRACT

A downhole electrical wet connector comprising a plug which is slidingly inserted into a socket, the socket comprising a series of wiper seals spaced apart by separation zones, each zone being individually supplied with dielectric fluid from a separate reservoir. A retractable insert is arranged in the socket and displaced by the plug during connection. The fluid pressure in each zone is individually regulated relative to ambient wellbore pressure and the pressure in adjacent zones and optionally equalized to minimize loss of fluid.

20 Claims, 11 Drawing Sheets

(56) References Cited

U.S. PATENT DOCUMENTS

| | | | | |
|---|---|---|---|---|
| 4,142,770 | A | 3/1979 | Butler et al. | |
| 4,174,875 | A | 11/1979 | Wilson et al. | |
| 4,390,229 | A | 6/1983 | Chevalier | |
| 4,537,457 | A * | 8/1985 | Davis, Jr. | E21B 17/028 439/190 |
| 4,767,349 | A | 8/1988 | Pottier et al. | |
| 4,795,359 | A * | 1/1989 | Alcock | H01R 13/523 439/201 |
| 4,806,114 | A | 2/1989 | Hopper | |
| 4,825,946 | A | 5/1989 | Schnatzmeyer | |
| 4,859,196 | A | 8/1989 | Durando et al. | |
| 4,909,320 | A | 3/1990 | Hebert et al. | |
| 4,997,384 | A | 3/1991 | Godfrey et al. | |
| 5,007,852 | A | 4/1991 | Dean et al. | |
| 5,052,941 | A | 10/1991 | Hernandez-Marti et al. | |
| 5,171,158 | A | 12/1992 | Cairns | |
| 5,194,012 | A * | 3/1993 | Cairns | H01R 13/523 439/201 |
| 5,358,418 | A | 10/1994 | Carmichael | |
| 5,577,925 | A | 11/1996 | Schnatzmeyer et al. | |
| 5,632,625 | A | 5/1997 | Faust | |
| 6,017,227 | A | 1/2000 | Cairns et al. | |
| 6,095,838 | A | 8/2000 | Brickett | |
| 6,332,787 | B1 | 12/2001 | Barlow et al. | |
| 6,736,545 | B2 * | 5/2004 | Cairns | G02B 6/3816 174/74 R |
| 6,932,636 | B2 | 8/2005 | Abbey et al. | |
| 7,114,970 | B2 | 10/2006 | Head | |
| 7,364,448 | B2 | 4/2008 | Cairns et al. | |
| 7,462,051 | B2 | 12/2008 | Hall et al. | |
| 7,500,859 | B2 | 3/2009 | Dubranna | |
| 7,640,993 | B2 | 1/2010 | Head | |
| 8,192,089 | B2 * | 6/2012 | Cairns | G02B 6/3816 385/138 |
| 8,267,707 | B2 | 9/2012 | Rogers | |
| 8,485,837 | B2 | 7/2013 | Head | |
| 8,746,354 | B2 | 6/2014 | Head | |
| 9,028,264 | B2 * | 5/2015 | Head | H01R 13/00 439/140 |
| 9,197,006 | B2 * | 11/2015 | Hack | H01R 13/523 |
| 9,225,114 | B2 * | 12/2015 | Sinclair | H01R 13/6276 |
| 2002/0123256 | A1 * | 9/2002 | Brickett | H01R 13/533 439/140 |
| 2013/0062050 | A1 | 3/2013 | Head | |
| 2014/0020907 | A1 | 1/2014 | Head | |
| 2014/0030904 | A1 | 1/2014 | Head | |
| 2014/0030906 | A1 | 1/2014 | Sinclair | |

* cited by examiner

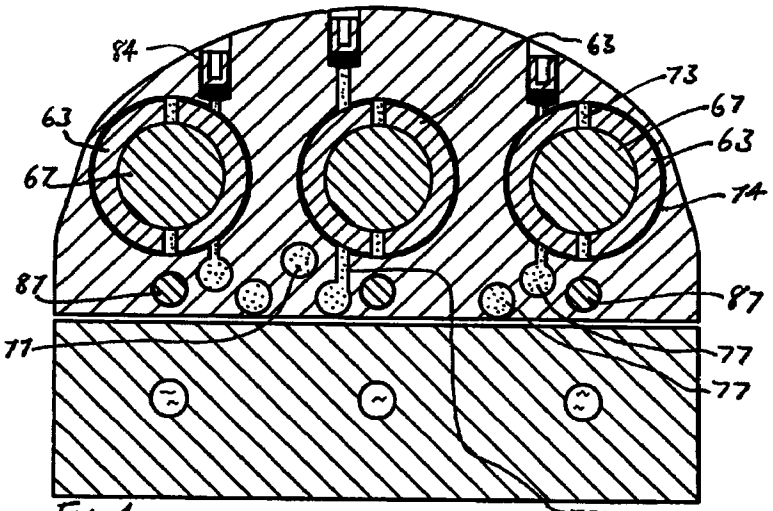
Fig. 4A
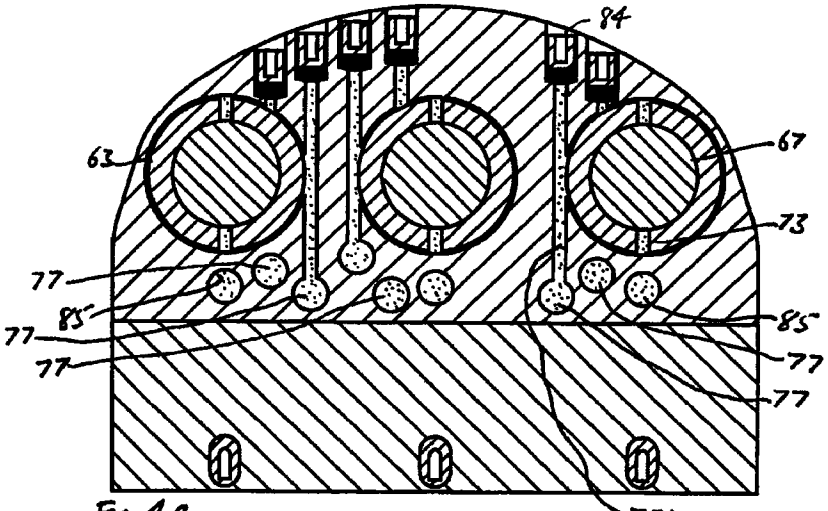
Fig. 4B
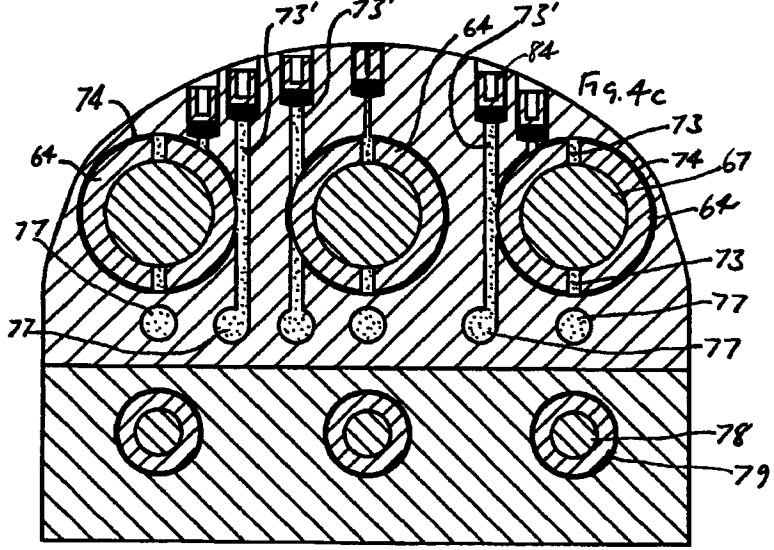
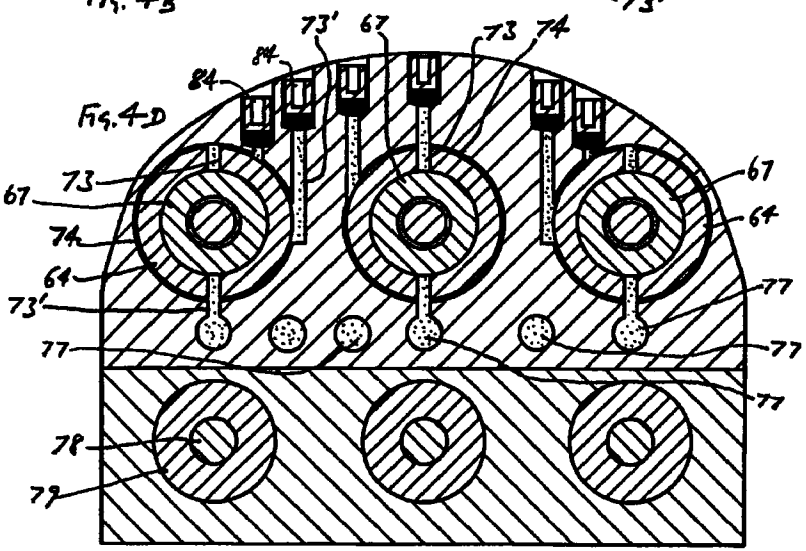

DOWNHOLE ELECTRICAL WET CONNECTOR

CROSS REFERENCE TO RELATED APPLICATIONS

This Application claims the priority to and the benefit of GB 1213164.5 filed Jul. 24, 2012, and entitled "Downhole Electrical Wet Connector", the entirety of which application is hereby incorporated by reference. This application is a continuation of U.S. patent application Ser. No. 13/897,481, filed May 20, 2013, entitled "Downhole Electrical Wet Connector", now U.S. Pat. No. 9,028,264.

BACKGROUND OF THE INVENTION

1. Field of the Disclosure

This invention relates to wet connectors for downhole use, which is to say, releasable connectors for electrical conductors which can be made and unmade in the fluid environment of a wellbore, particularly but not exclusively a hydrocarbon well.

2. Description of the Related Art

Wet connectors are used in hydrocarbon boreholes to releasably and remotely connect downhole equipment such as an electrical submersible pump (ESP), sensor or other tool to a conductor such as a power or signal line. The tool may be retrievably deployed in the borehole, e.g. on a wireline, or may be fixedly installed in the casing or other tubing in the wellbore. Similarly, the power or signal line may be retrievably suspended in the wellbore or may be fixedly installed on the casing or other tubing.

Hydrocarbon wells typically contain a mixture of electrically conductive fluids at elevated temperature and pressure, and since ESPs are typically powered at relatively high voltages, e.g. around 600V, the wet connectors are particularly vulnerable to failure when internal contamination of the connector by wellbore fluids leads to flashover between the conductors.

A wet connector typically comprises a male part comprising one or a group of plugs, and a female part comprising a corresponding number of sockets, the or each respective plug and socket having a single electrical contact or an array of contacts. Either the male or the female part may be arranged on the tool, with the other part being arranged on the power or signal line. For ESPs and other electrical tools running on a three phase power supply, the connector may comprise for example a single plug and socket having three axially spaced contacts, or a group of three plugs and sockets, each having a single electrical contact.

In order to exclude wellbore fluids from the connector, it is usual to occlude the bore of the socket with a retractable insert which is displaced by the plug. The sliding interface between the socket and the insert is protected by one or a series of annular seals known as wiper seals, hereinafter also referred to as wipers, which slidingly wipe contaminants from the surface of the plug as it enters the socket.

In practice it is found that as the plug enters the socket, contaminants clinging to the plug may travel past the or each wiper to form an electrically conductive path, leading to failure of the connector.

In order to reduce contamination, it is known for example from U.S. Pat. No. 4,997,384 and U.S. Pat. No. 4,825,946 to fill the socket with dielectric fluid which flushes the plug as it is inserted.

U.S. Pat. No. 4,767,349 discloses a wet connector in which a reservoir of dielectric fluid is arranged to energize an axial array of wiper seals as the plug is inserted, increasing the sealing force of each seal so as to assist in breaking the film of conductive fluid on the surface of the plug.

Although most wet connectors employ an array of wiper seals arranged along the insertion axis of the plug, which might be expected to effectively cleanse the plug of conductive fluids, it is found in practice that flashover still occurs between the contacts.

WO2010/122342 discloses a wet connector in which the plug is enclosed within a retractable sheath and may be repeatedly flushed by dielectric fluid expelled from a reservoir into the wellbore so as to cleanse the connector of contaminants. However, the reservoir of dielectric fluid may be exhausted by repeated flushing.

GB 2477214 A discloses a wet connect system in which a conductor is slidably housed in a conduit extending from the wellhead, through which a dielectric fluid may be pumped. Again, this is effective in excluding contaminants, but requires the installation of the conduit to the deployed depth of the wet connector.

BRIEF SUMMARY

It is the object of the present invention to provide a self-contained downhole wet connector which more effectively excludes contaminants from the contacts while allowing repeated connection and disconnection.

According to the present invention there is provided a downhole electrical wet connector as defined in the claims.

It is hypothesized that the continuing problem of flashover across multiple wiper seals, even in the presence of a dielectric fluid, may be due in part to a local pressure differential which arises across each wiper seal as the plug is inserted, causing a small volume of conductive fluids to flow across the wiper seal together with the plug.

The invention overcomes this problem by providing the separation zone between each pair of adjacent wiper seals with a separate port and conduit external to the socket through which dielectric fluid is supplied to the socket from a reservoir. This allows dielectric fluid to flow to and from the separation zone during insertion of the plug, which makes it possible to regulate or equalize the pressure across each wiper seal so as to prevent the development of undesirable pressure gradients as the plug enters the socket. Preferably, each respective separation zone is supplied from a separate reservoir of dielectric fluid so that contaminants cannot migrate through the reservoir from one separation zone to another. The invention provides a compact and self-contained wet connector which can more effectively exclude contaminants with little or no loss of dielectric fluid.

Further features and advantages will be evident from the illustrative embodiments of the invention which will now be described, purely by way of example and without limitation to the scope of the claims, and with reference to the accompanying drawings, in which:

BRIEF DESCRIPTION OF THE DRAWINGS

FIGS. 1A-1C show a first wet connector comprising male and female components in use, wherein:

FIG. 1A is a section through part of an oil well comprising the female component;

FIG. 1B shows an electrical submersible pump comprising the male component; and FIG. 1C shows the pump installed in the well with the male and female components connected together;

FIGS. 4A, 4B, 4C and 4D are cross sections through the female component, respectively at lines A-A, B-B, C-C and D-D of FIG. 5B;

Corresponding reference numerals indicate corresponding features in each of the figures.

DETAILED DESCRIPTION OF THE SPECIFIC EMBODIMENTS

Figure 1A:
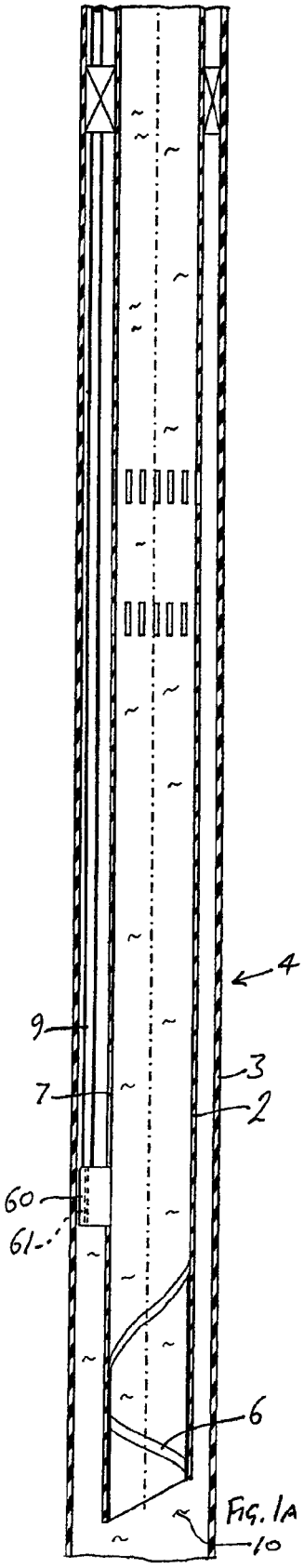
Figure 1B:
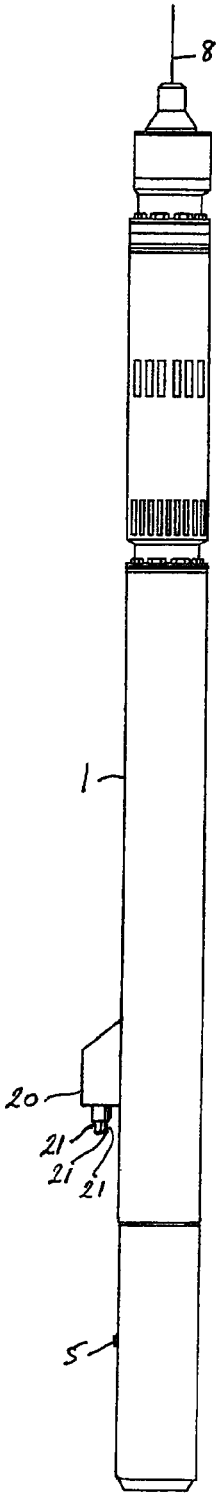
Figure 1C:
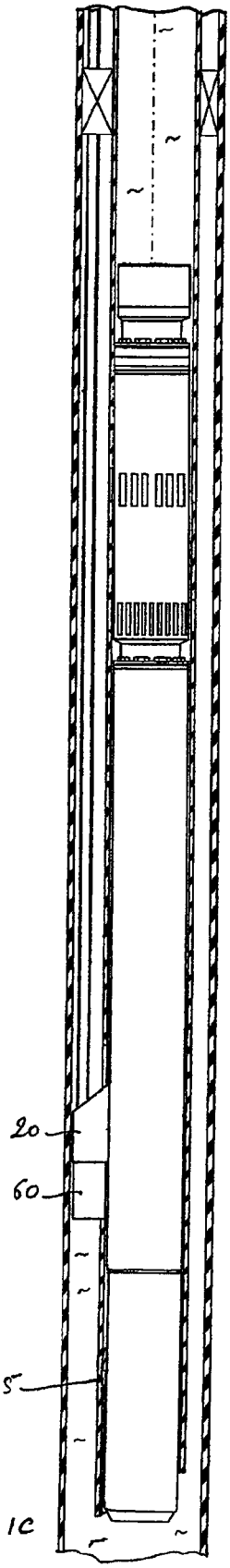
Figure 2:
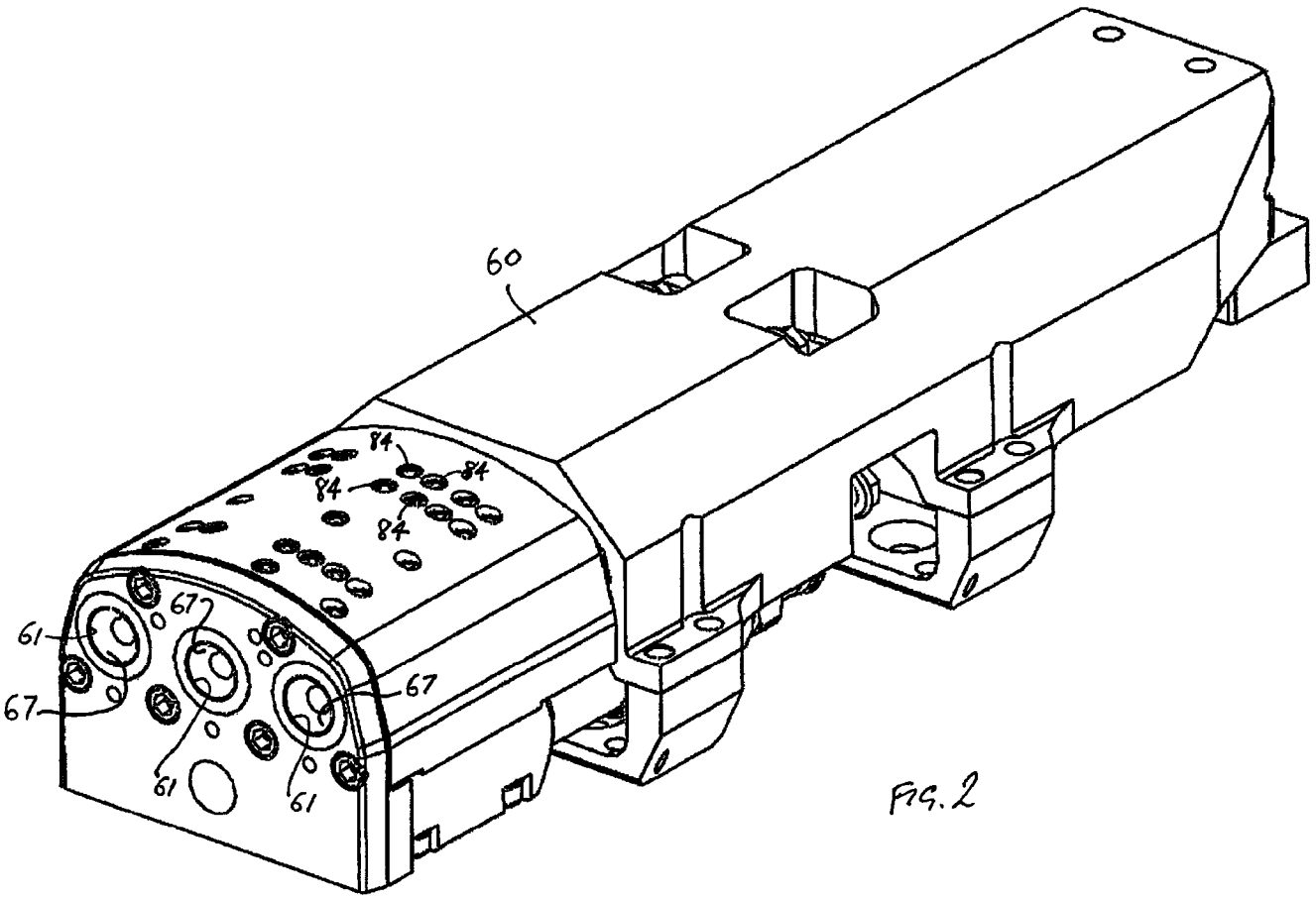
FIG. 2 shows the female component in more detail.
Figure 3:
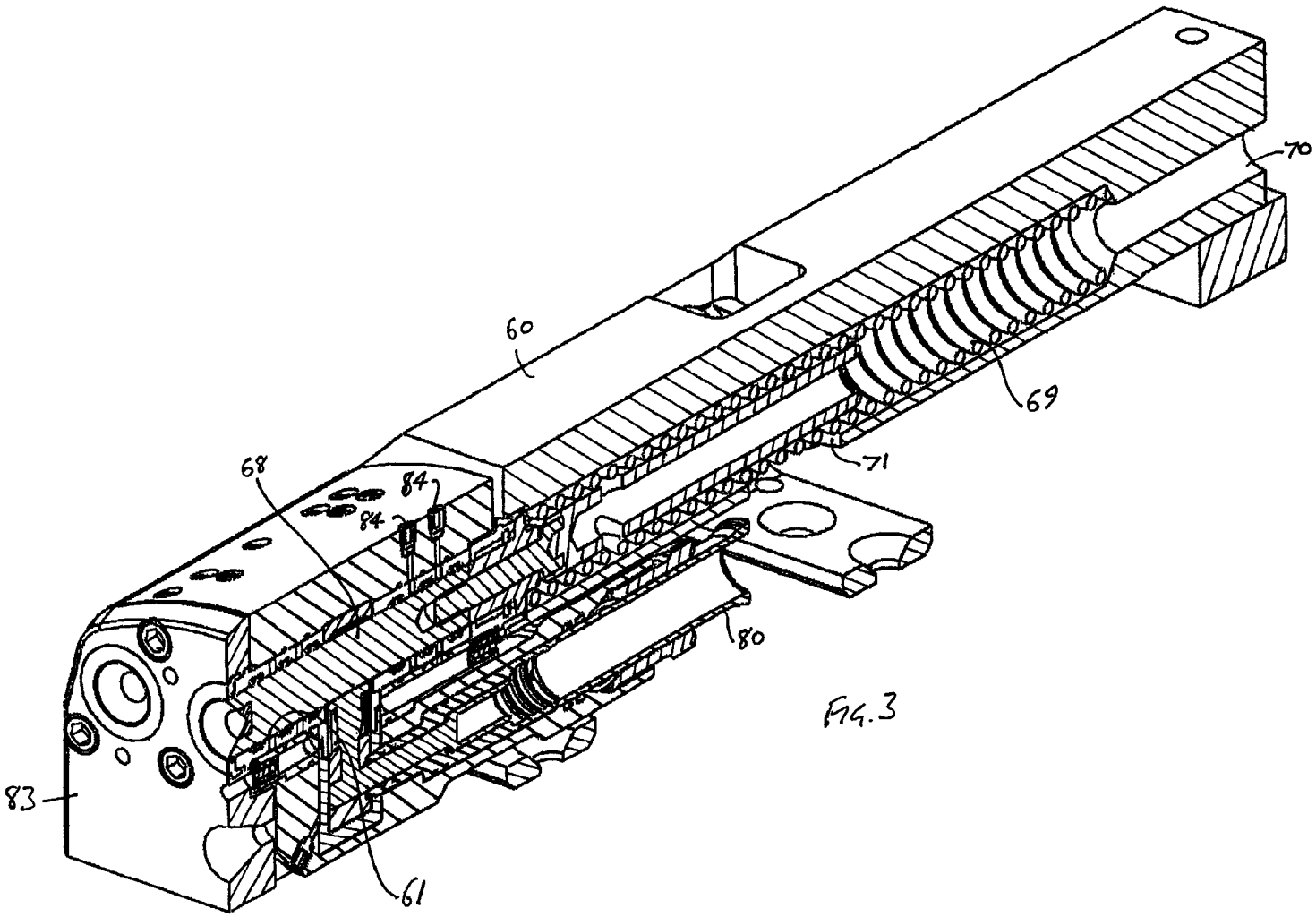
FIG. 3 shows a longitudinal section through the female component.
Figure 5A:
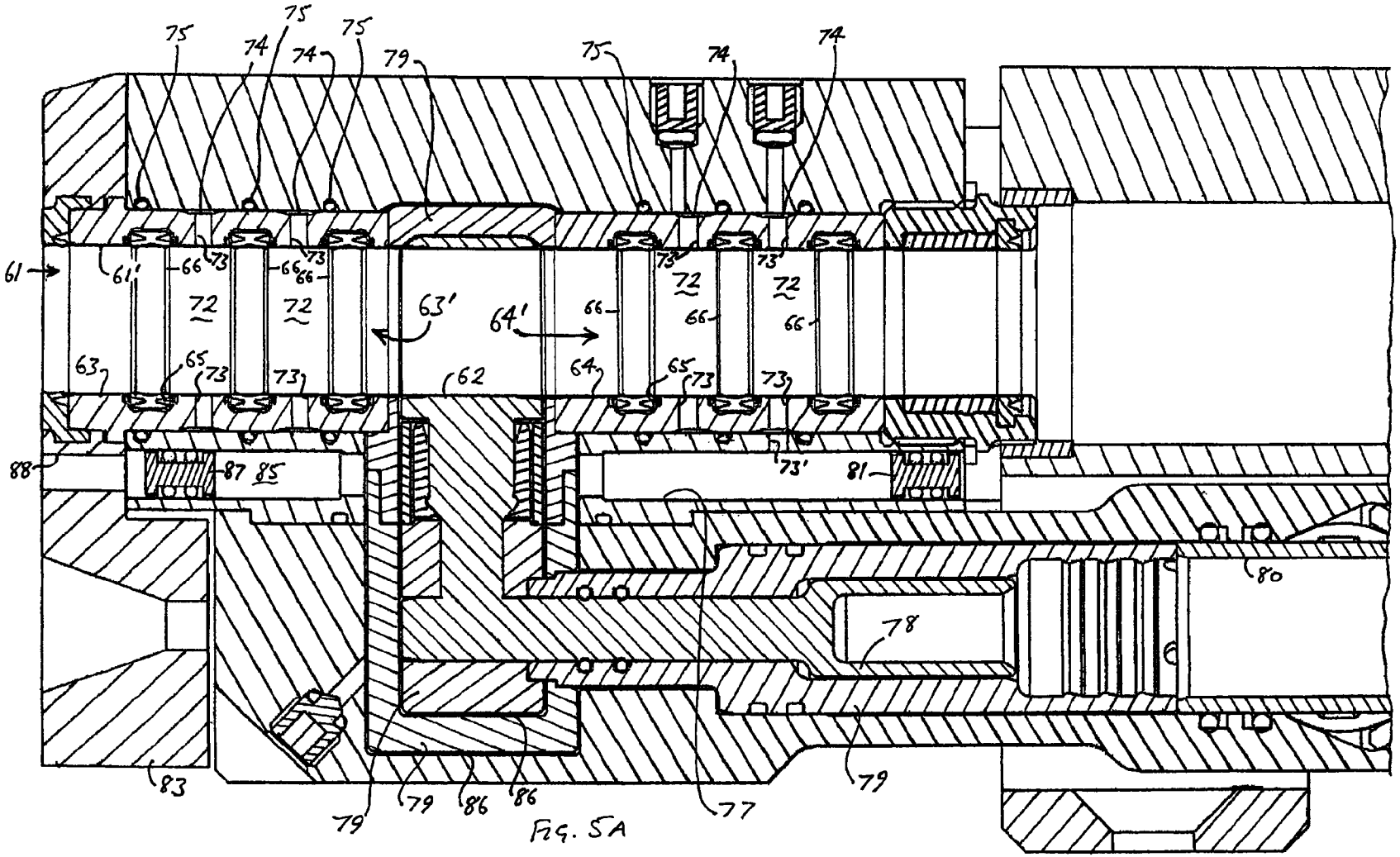
FIG. 5A is an enlarged view of part of the longitudinal section of FIG. 3, with the insert removed.
Figure 5B:
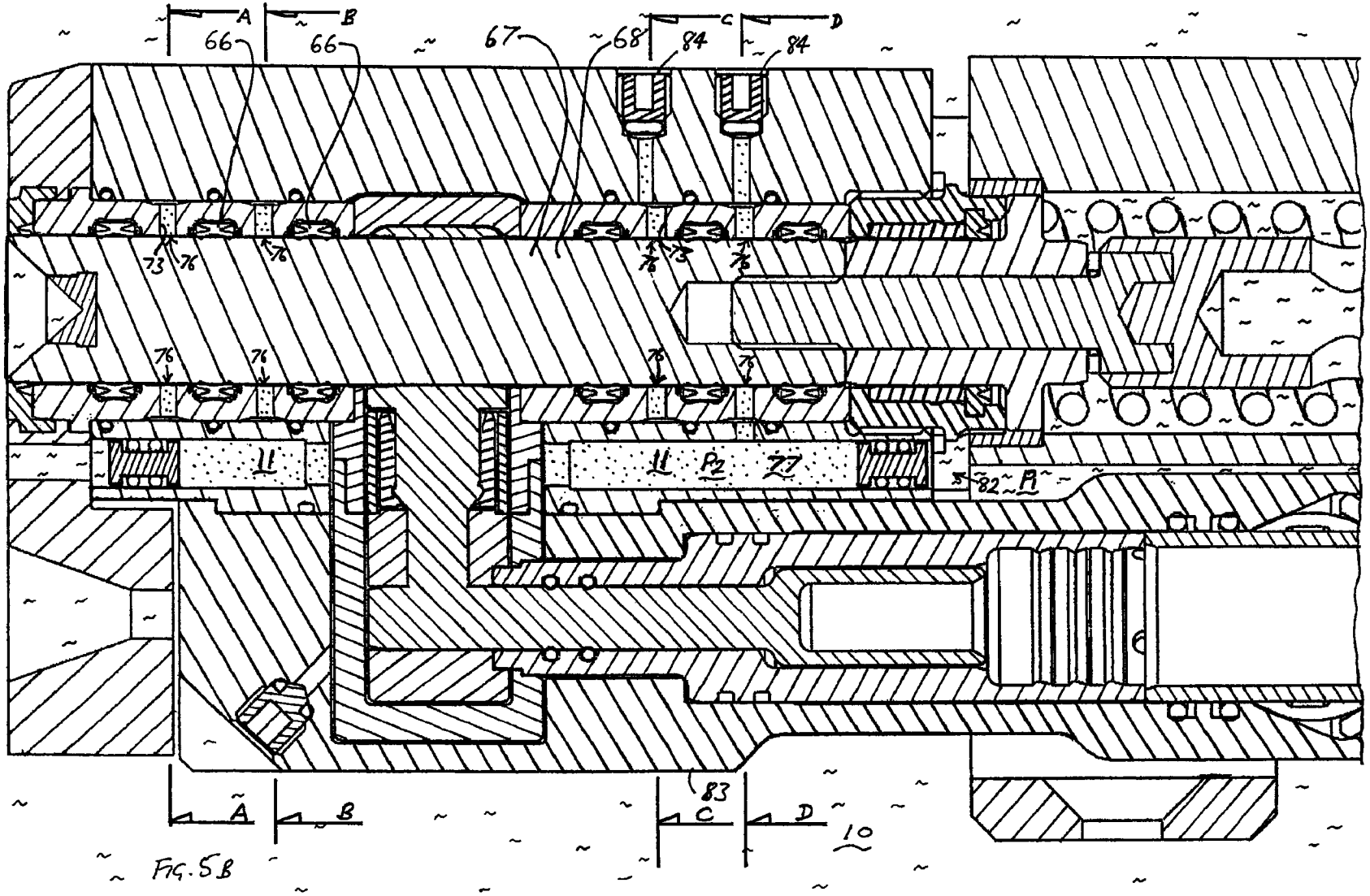
FIG. 5B is a longitudinal section corresponding to FIG. 5A, showing the female component in use.

Referring to FIGS. 1A-1C, 2-3, 4A-4C, 5A-5B, 6-7, and 8A-8B, a downhole electrical wet connector comprises a male component 20 and a female component 60. In the illustrated example, the male component is mounted on an ESP 1 while the female component 60 is mounted on a tailpipe 2 within the casing 3 of a hydrocarbon well 4 containing wellbore fluid at ambient pressure P1. The male component is retracted into the outer housing of the ESP while it is deployed down the well on a wireline 8. The ESP has a lug 5 which engages an inclined profile 6 in the tailpipe so as to orient the male component 20 into alignment with a window 7 in the tailpipe, allowing it to extend outwardly to its use position as shown. The male component includes an array of three plugs 21, each plug having a first annular electrical contact 22 which is connected to a respective winding of the motor of the ESP, while the female component includes an array of three cylindrical sockets 61, each socket having a second annular electrical contact 62 which is connected via a cable 9 (shown only in FIGS. 1A and 1C) to an electrical supply at the wellhead. When the male component is aligned with the window, the ESP is lowered to engage the plugs in the sockets, whereby the respective contacts 22, 62 of each plug and socket are connected together, the contact 62 being slightly resiliently deformable so as to grip the contact 22.

Referring particularly to FIGS. 2-3, 4A-4C, 5A-5B, 6-7, and 8A-8B, the contact 62 is connected to the conductor of the cable 9 via a copper connector 78, the conductive parts being surrounded by ceramic insulation 79 and the insulating jacket of the cable sealingly received in a sleeve 80.

The inner surface 61' of each socket is formed by the respective inner bores of first and second ceramic sleeves 63, 64 which are aligned along the longitudinal axis X1-X1 of the socket on either side of the annular contact 62. Each of the sleeves 63, 64 has three internal annular recesses 65, with an annular wiper seal 66 being arranged in each of the recesses so that the two sleeves support two respective arrays 63', 64' of wiper seals, each array comprising three wiper seals arranged in series in the socket.

A retractable insert 67 is arranged in each socket 61. The insert comprises a cylindrical ceramic rod 68 which is resiliently biased to a rest position (FIG. 5B) by a spring 69. Ports 70 and 71 expose the rearward end of the insert 67 to the ambient pressure P1 of the wellbore fluid 10 so that the reciprocal motion of the insert is independent of ambient pressure.

Each wiper seal comprises an annulus which is generally X-shaped when considered in longitudinal section as shown; this is found to be effective in wiping contaminants from the surface of the plug and insert during connection and disconnection, while providing a relatively light gripping force which allows the insert to return easily to its rest position (FIG. 5B) under its restoring spring force. Alternatively, other conventional types of wiper seals may be employed.

Each pair of adjacent wiper seals 66 are separated by a respective separation zone 72, comprising the region of the socket between the two seals in which the insert is slidingly received in its rest position, so that each array 63', 64' comprises three wiper seals separated by two respective separation zones. In use, each separation zone thus comprises the small annular clearance gap formed between two adjacent seals between the inner surface of the socket and the outer surface of the insert or plug; the clearance gap may optionally be widened by a further shallow annular recess (not shown) formed in the inner surface of the socket to distribute dielectric fluid around the insert or plug between the two respective seals.

Each respective separation zone 72 has at least one respective dielectric fluid conduit 73 external to the socket which opens into the respective separation zone at port 76, each conduit 73 communicating with a respective annular recess 74 formed in the external surface of the respective sleeve 63 or 64. (In the illustrated embodiment, each separation zone 72 has two conduits 73 opening into the separation zone at ports 76, both conduits communicating with the same recess 74, although alternatively only one could be provided.) Each recess 74 is isolated from the other recesses 74 by O ring seals 75 and communicates via respective further individual fluid conduits 73' with a respective individual reservoir 77 of dielectric fluid 11, so that each separation zone 72 is supplied with dielectric fluid from a separate reservoir at a dielectric fluid pressure P2 as further discussed below. It will be understood therefore that each array 63', 64' is provided with two separate reservoirs, each reservoir containing a separate body of dielectric fluid, wherein each of the separation zones is fluidly connected with a respective one of the reservoirs. Each of the reservoirs 77 is pressure balanced by means of a piston 81 which separates the dielectric fluid 11 from the ambient wellbore fluid 10 which is applied to the respective face of the piston via an aperture 82 in the outer housing 83 of the female component. Each of the reservoirs is provided with a vent 84 so that the reservoir can be individually filled via its respective communicating conduit or conduits 73, 73' and/or recess 74 with dielectric fluid; in a development (not shown), a single filling passage may be provided, which for example may communicate with each reservoir via a respective non-return valve.

A further reservoir 85 communicates with a small gap 86 surrounding the insulated conductive parts and communicating with the region of the socket containing the contact 62, whereby this region is also pressure balanced via piston 87 acted on by wellbore fluid 10 via aperture 88 opening through the housing 83 into the wellbore.

Figure 6:
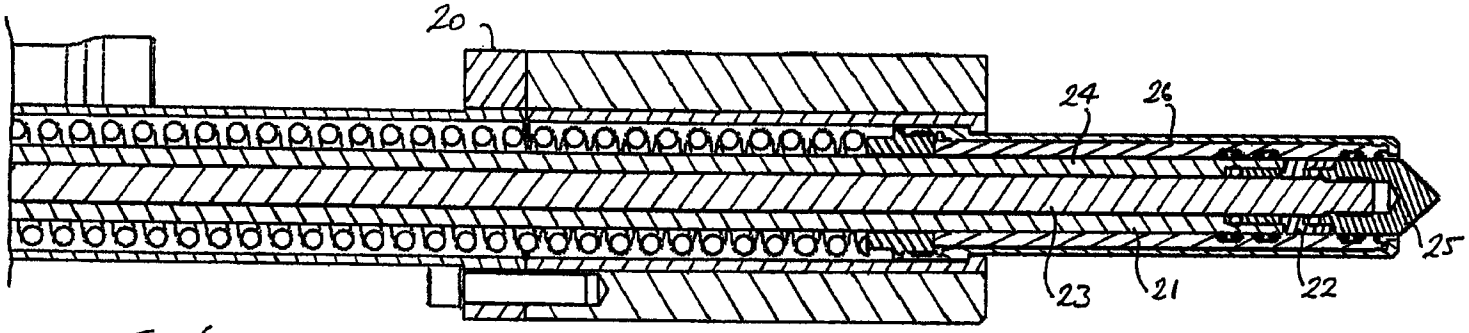
FIG. 6 is a longitudinal section through one of the plugs of the male component.

Referring particularly to FIG. 6, each plug 21 comprises a central conductor 23 surrounded by ceramic insulation 24 and electrically connected to the annular contact 22 which is arranged between the ceramic insulation 24 and the ceramic tip 25. The plug 21 is protected by a retractable sheath 26 which is spring biased to the rest position as shown (FIG. 6).

Figure 7:
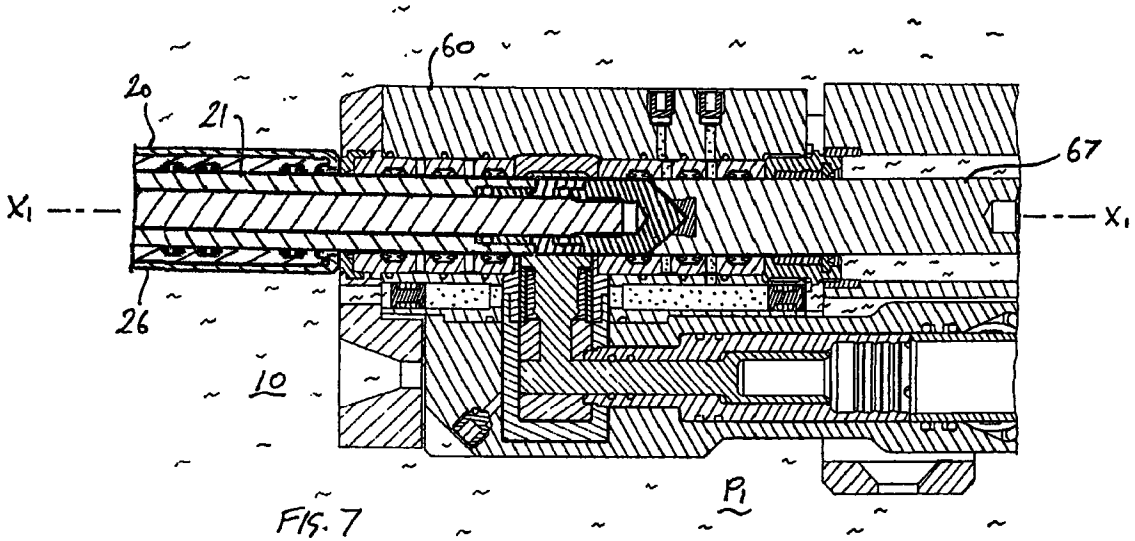
FIG. 7 is a longitudinal section corresponding to FIG. 5B and FIG. 6, showing the male and female components connected together.

In use, the plugs are aligned with the sockets, whereby each sheath 26 abuts against the outer housing 83; axial movement along axis X1-X1 causes the sheath to retract while the plug enters the socket. As it is slidingly inserted into the socket the plug displaces the insert and travels through the respective separation zones and wiper seals of the first array 63', the series of wiper seals consecutively wiping any remaining traces of wellbore fluid 10 from its outer surface until the first and second contacts 22, 62 are electrically connected (FIG. 7). The second array 64' isolates the contact 62 from the wellbore fluid 10 behind the insert.

Figure 8A:
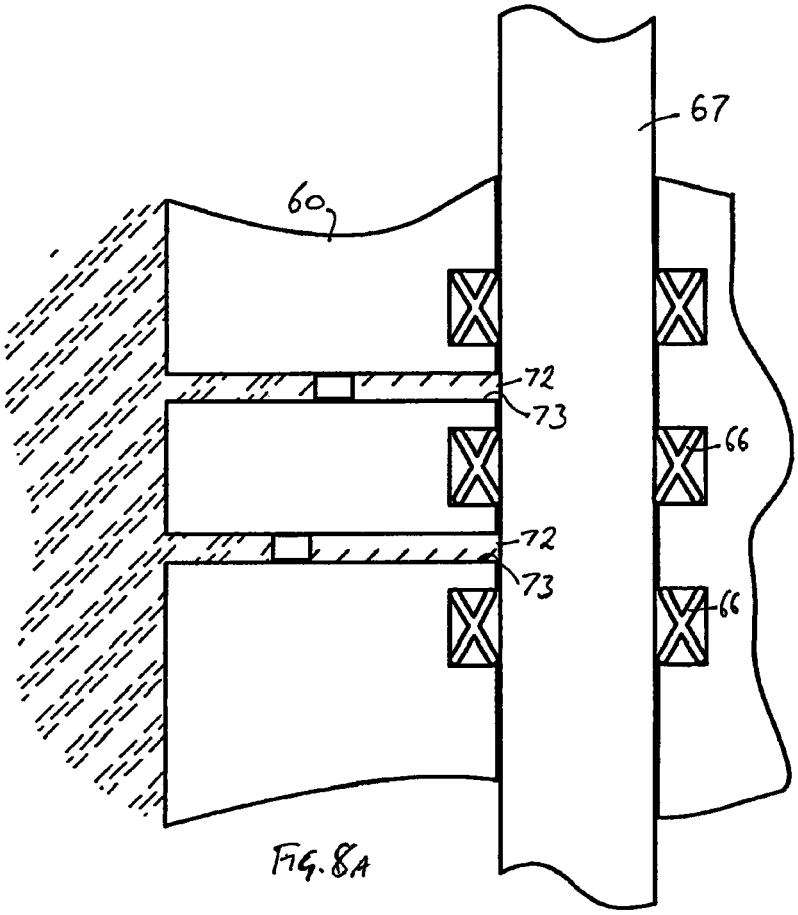
FIG. 8A is a schematic illustration of the pressure regulating means of the first wet connector.
Figure 8B:
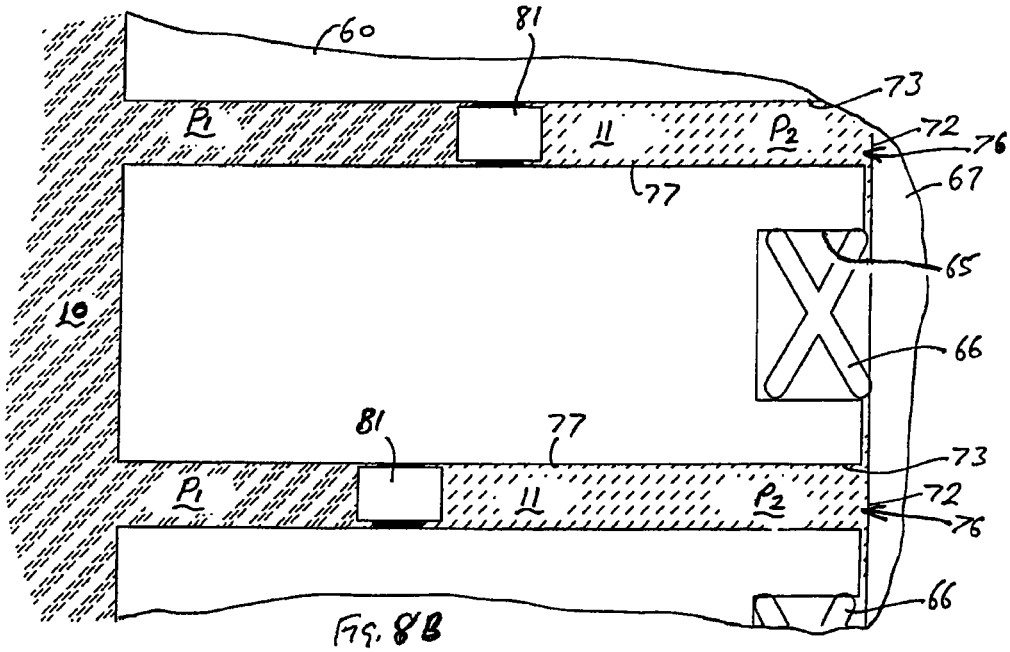
FIG. 8B is an enlarged view of part of FIG. 8A.

Each piston 81, 87 is free to move in either direction. Referring to FIGS. 8A-8B, it will be appreciated that each piston 81 thus comprises pressure regulating means whereby the dielectric fluid pressure P2 of each separation zone is maintained (in particular during connection and disconnection of the plug and the socket) in constant relation to the ambient pressure P1 in the wellbore external to the connector and in constant relation to the dielectric fluid pressure of the respective adjacent separation zone. Specifically, the dielectric fluid pressure P2 of each separation zone is maintained constantly equal to the ambient pressure P1 so that the two separation zones of each array are maintained at an equal dielectric fluid pressure during connection and disconnection of the plug and the socket. This prevents the development of adverse pressure gradients (which would tend to cause contaminants to flow from an outer separation zone to an inner separation zone) as the plug enters the socket. Moreover, since all pressures are equalized and the profile of the plug and the insert may be perfectly cylindrical as shown there is little or no loss of dielectric fluid with repeated connection and disconnection, whereby the reservoirs may be very small, resulting in a compact assembly.

By equalizing the fluid pressure across each seal, it is also possible to minimize the sealing force (energization) of each seal without impairing its ability to wipe contaminants from the plug. This in turn minimizes the frictional resistance to the reciprocal motion of the plug and the insert, and so also makes it possible to minimize the restoring force of the return spring 69, making connection and disconnection easier and ensuring that the insert returns more reliably to its rest position.

Although it is therefore advantageous to equalize the fluid pressure across each seal, it will be appreciated that alternative pressure regulation regimes may be adopted, whereby the pressure regulating means may include non-return valves, pressure relief valves and the like as exemplified below.

Figure 9A:
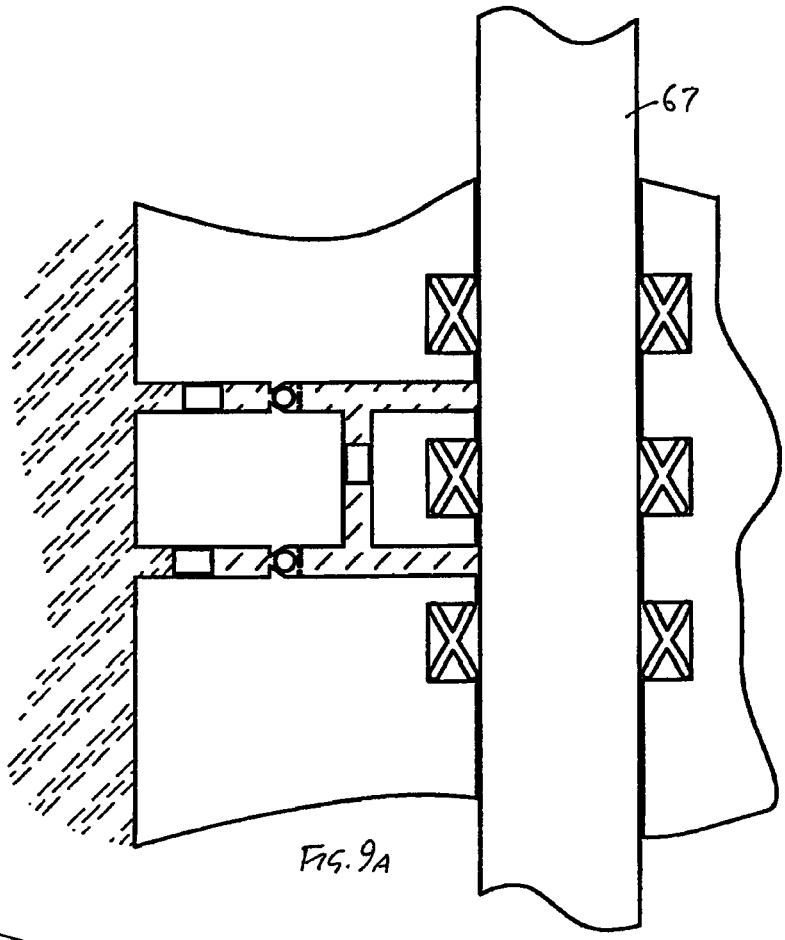
FIG. 9A is a schematic illustration of an alternative embodiment of the pressure regulating means of FIG. 8A.
Figure 9B:
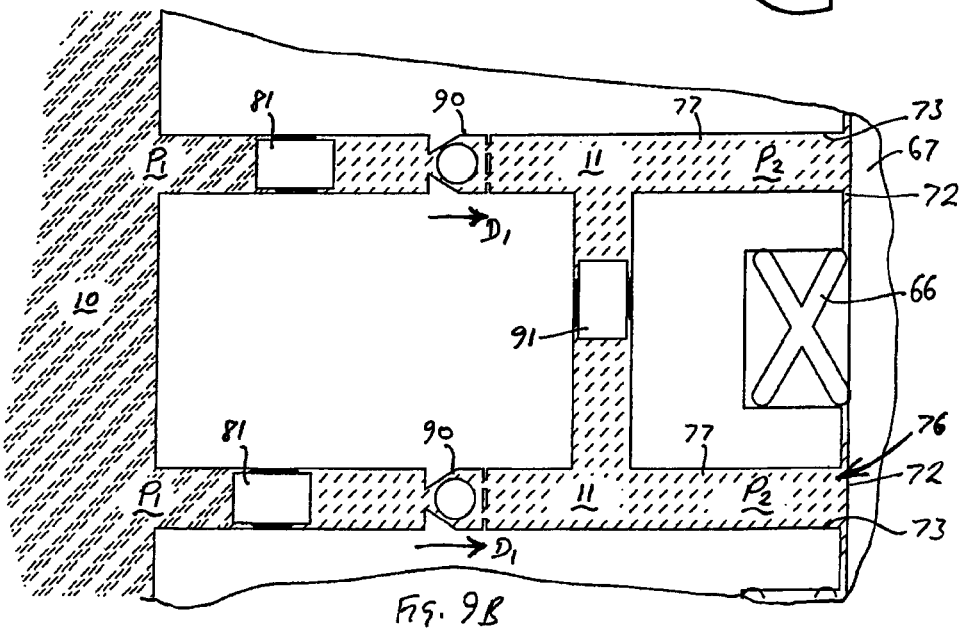
FIG. 9B is an enlarged view of part of FIG. 9A.

Referring to FIGS. 9A-9B, in an alternative second embodiment, each reservoir 77 is isolated from the wellbore fluid via a piston 81 and non-return valve 90 which permits dielectric fluid to flow inwardly in direction D1 in response to elevated ambient pressure in the wellbore, maintaining the dielectric fluid pressure P2 at a value at least equal to the ambient pressure P1 but, by preventing flow in the reverse direction, permits the dielectric fluid pressure P2 in each separation zone 72 to rise above ambient pressure P1 as the plug is inserted into the socket. Like the first embodiment, the dielectric fluid pressure P2 of each separation zone is equalized, here via piston 91 which separates the reservoirs. Thus although (like the first embodiment) the dielectric fluid pressure P2 of each separation zone is regulated in relation to the ambient pressure P1 external to the connector, it is not maintained in constant relation to the ambient pressure P1. The pressure rise during connection may cause a small loss of dielectric fluid, which however will be forced outwardly from the socket to flush the plug.

Figure 10A:
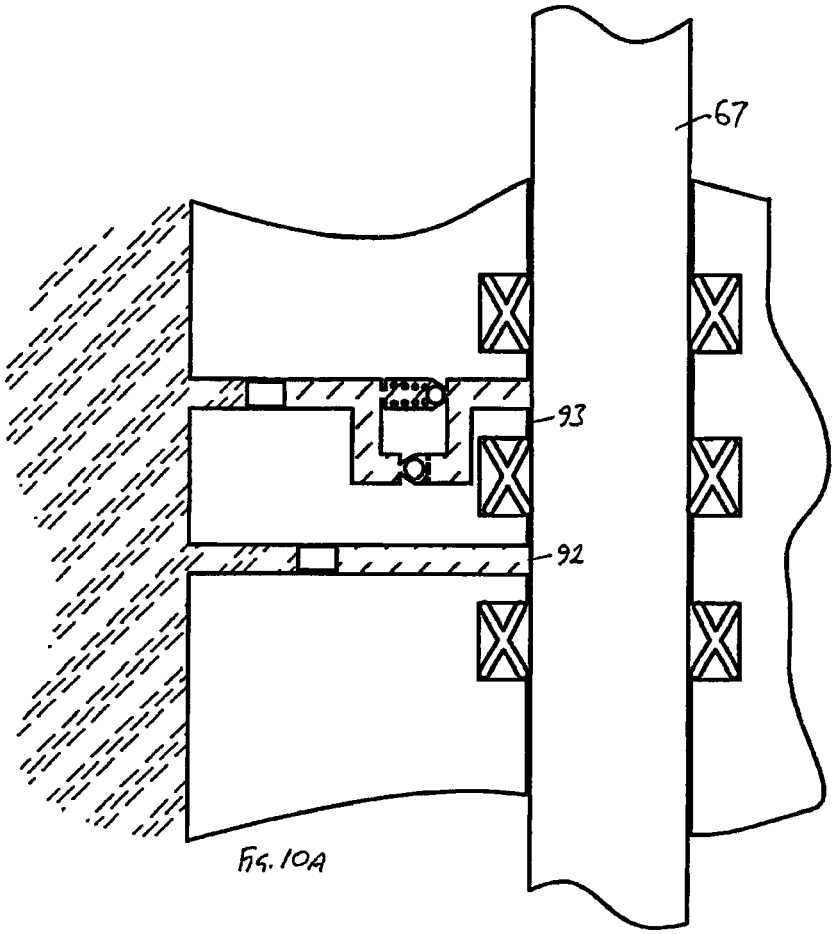
FIG. 10A is a schematic illustration of an alternative embodiment of the pressure regulating means of FIG. 8A.
Figure 10B:
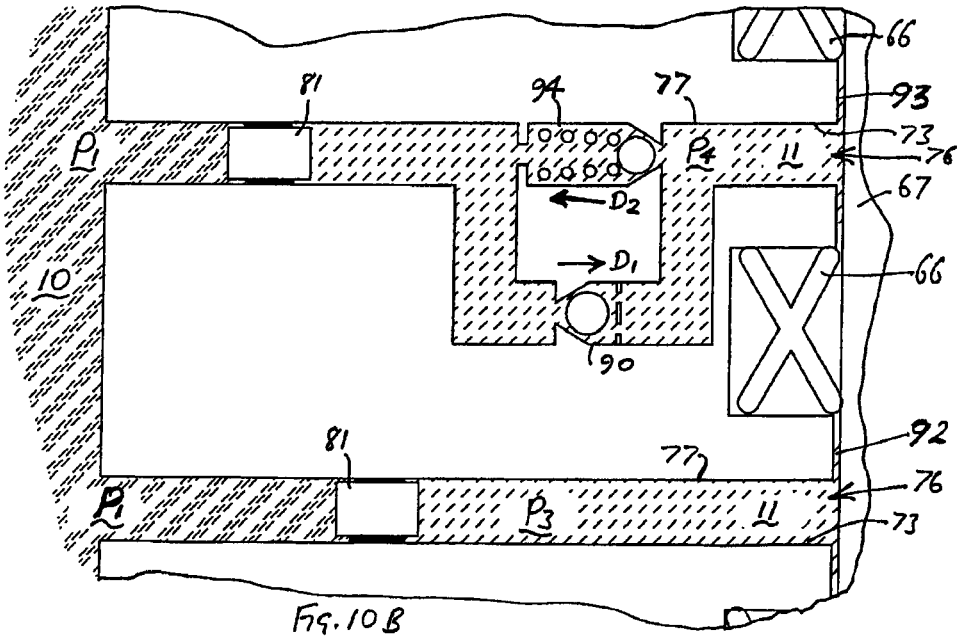
FIG. 10B is an enlarged view of part of FIG. 10A.

Referring to FIGS. 10A-10B, in an alternative third embodiment, a piston 81 maintains the dielectric fluid pressure P3 in a first separation zone 92 at a value constantly equal to the ambient pressure P1. Another piston 81 in series with a non-return valve 90 permitting flow in an inward direction D1 constantly maintains the dielectric fluid pressure P4 in the adjacent separation zone 93 at a value at least equal to the ambient pressure P1. A pressure relief valve 94 is arranged in parallel with the non-return valve 90 and spring biased to permit flow in the outward direction D2 when the dielectric fluid pressure P4 in the separation zone 93 rises to a predetermined value in excess of the ambient pressure P1. As the plug enters the socket, the pressure in the two adjacent separation zones is thus constantly regulated so as to achieve a small, predetermined pressure gradient between the two zones, which may be arranged to cause a small outflow of dielectric fluid from the inner to the outer zone, i.e. outwardly from the socket, scavenging any traces of wellbore fluid from the surface of the plug as it is inserted. Optionally, the profile of the plug or the insert may be slightly tapered or otherwise adapted as required to slightly pressurize the socket during insertion of the plug.

Figure 11A:
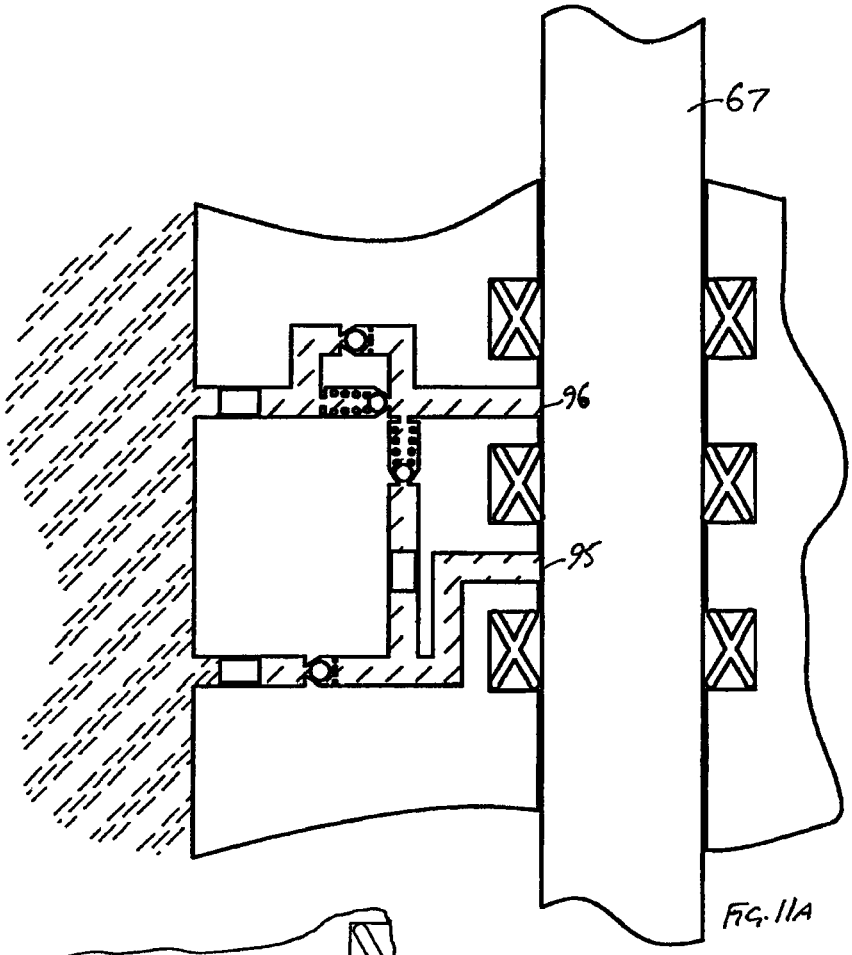
FIG. 11A is a schematic illustration of an alternative embodiment of the pressure regulating means of FIG. 8A.
Figure 11B:
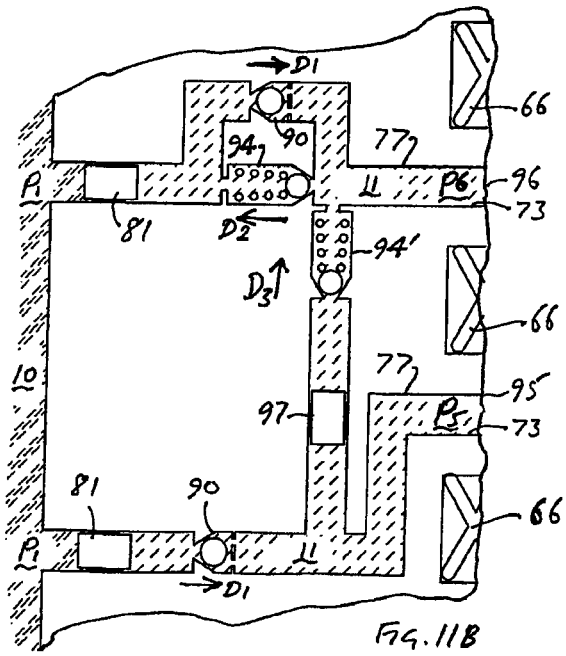
FIG. 11B is an enlarged view of part of FIG. 11A.

Referring to FIGS. 11A-11B, in an alternative third embodiment, the dielectric fluid pressure P5 a first separation zone 95 is constantly maintained at least equal to the ambient pressure P1 by a piston 81 in series with a non-return valve 90 opening in the inward direction D1. The dielectric fluid pressure P6 in the adjacent separation zone 96 is also maintained at least equal to the ambient pressure P1 by another piston 81 in series with another non-return valve 90 opening in the inward direction D1, but also has a spring biased pressure relief valve 94 in parallel with the valve 90 and opening in the outward direction D2 when the dielectric fluid pressure P6 exceeds P1 by a predetermined value. A second pressure relief valve 94' is arranged between the two reservoirs 77 in series with a piston 97 which separates the fluid in the two reservoirs, and arranged to open in the direction D3 when the dielectric fluid pressure P5 exceeds P6 by a predetermined value. Slight pressurization of the socket by the plug during connection thus establishes a desirable pressure gradient whereby P5>P6>P1, flushing contaminants outwardly from the socket.

In summary, a preferred embodiment provides a downhole electrical wet connector comprising a plug which is slidingly inserted into a socket, the socket comprising a series of wiper seals spaced apart by separation zones, each zone being individually supplied with dielectric fluid from a separate reservoir. A retractable insert is arranged in the socket and displaced by the plug during connection. The fluid pressure in each zone is individually regulated relative to ambient wellbore pressure and the pressure in adjacent zones and optionally equalized to minimize loss of fluid.

In yet further alternative embodiments, only one array of wiper seals may be provided; in less preferred embodiments, the or each array may comprise only two wiper seals separated by a single separation zone. Of course, the or each array may include more than three wiper seals separated by more than two respective separation zones, each separation zone preferably having a respective individual reservoir of dielectric fluid (which may be separated by pressure equalizing pistons), although in less preferred embodiments, a single shared reservoir may be used.

The pressure regulating means may comprise any suitable means whereby the dielectric fluid pressure may be adjusted by reference to the ambient pressure in the wellbore. Preferably this is a simple piston, a diaphragm or any other moveable or flexible barrier which separates the fluids while transmitting pressure between them, although of course it could be a more complex mechanism including sensors operably connected with pressure generating means such as a pump or pressure reservoir (e.g. a compressed gas) which adjusts the dielectric fluid pressure to the required value.

The connector may be used to connect both power and signal lines. In alternative embodiments, the female part may be mounted on the tool and the male part on the well casing or production tubing. The or each plug and socket may have a plurality of spaced contacts rather than a single contact. Either or both of the male and female parts may be suspended in the wellbore.

Those skilled in the art will readily conceive further adaptations within the scope of the claims.

I claim:

1. A downhole electrical wet connector comprising:

a plug having a first electrical contact;

a socket having a second electrical contact;

a retractable insert arranged in the socket;

wherein the plug is insertable into the socket so as to displace the retractable insert and electrically connect the first electrical contact and the second electrical contact;

at least one array of wiper seals;

wherein the at least one array of wiper seals comprises at least two wiper seals separated by a separation zone; and wherein the at least two wiper seals being arranged in series in the socket to wipe contaminants from the plug or the retractable insert;

the retractable insert and the plug being slidingly movable through the separation zone;

wherein the separation zone is fluidly connected with a dielectric fluid reservoir external to the socket to supply the separation zone with a dielectric fluid at a dielectric fluid pressure.

2. A downhole electrical wet connector according to claim 1, further comprising a pressure regulating piston disposed in the dielectric fluid reservoir to regulate the dielectric fluid pressure of the separation zone in relation to the dielectric fluid pressure of an adjacent separation zone or to an ambient pressure external to the connector.

3. A downhole electrical wet connector according to claim 1, further comprising a pressure regulating piston disposed in the dielectric fluid reservoir to maintain the dielectric fluid pressure of the or each separation zone in constant relation to the dielectric fluid pressure of an adjacent separation zone or to an ambient pressure external to the connector during connection and disconnection of the plug and the socket.

4. A downhole electrical wet connector according to claim 1, wherein the second electrical contact is arranged between two arrays of wiper seals.

5. A downhole electrical wet connector according to claim 1, wherein the at least one array of wiper seals comprises at least three wiper seals separated by at least two separation zones.

6. A downhole electrical wet connector according to claim 1, wherein the at least one array of wiper seals comprises at least three wiper seals separated by at least two separation zones, wherein the at least two separation zones are maintained at an equal dielectric fluid pressure during connection and disconnection of the plug and the socket.

7. A downhole electrical wet connector according to claim 1, wherein the at least one array of wiper seals comprises at least three wiper seals separated by at least two separation zones, wherein each of the at least two separation zones are maintained at a dielectric fluid pressure equal to an ambient pressure external to the connector during connection and disconnection of the plug and the socket.

8. A downhole electrical wet connector according to claim 5, further comprising at least two dielectric fluid reservoirs, wherein each of the at least two dielectric fluid reservoirs contain a separate volume of the dielectric fluid, and wherein each of the at least two separation zones is fluidly connected with a respective one of the at least two dielectric fluid reservoirs.

9. A method of making a downhole electrical wet connection comprising:

deploying a plug within a casing of a well, the plug having a first electrical contact;

deploying a socket into the well, the socket having a second electrical contact;

engaging the plug in the socket;

displacing a retractable insert within the socket during the engaging so as to electrically connect the first electrical contact and the second electrical contact, wherein the retractable insert is slidingly disposed at least partially within a first separation zone, and wherein the first separation zone is supplied with a dielectric fluid and is between a first series of wiper seals;

wiping contaminants from the plug as the plug travels through the first series of wiper seals and the first separation zone during the engaging; and equalizing a dielectric fluid pressure of the dielectric fluid in the first separation zone in relation to an ambient fluid pressure external to the socket.

10. The method of claim 9, further comprising:

slidingly disposing the retractable insert at least partially within a second separation zone, wherein the second separation zone is supplied with the dielectric fluid and is between a second series of wiper seals; and wiping contaminants from the plug as the plug travels through the second series of wiper seals and the second separation zone during the engaging.

11. The method of claim 10, wherein the second electrical contact is disposed between the first series of wiper seals and the second series of wiper seals to electrically connect with the first electrical contact.

12. The method of claim 10, further comprising maintaining an equal dielectric pressure between the first separation zone and the second separation zone during the step of engaging.

13. A downhole electrical wet connection system comprising:

a plug having a first electrical contact;

a socket having a second electrical contact and a retractable insert;

wherein the plug is adapted for insertion into the socket and to displace the retractable insert until the first electrical contact and the second electrical contact are electrically connected;

wherein the socket comprises a first series of wiper seals spaced apart by a first separation zone, the plug adapted to travel through the first separation zone as the first series of wiper seals wipe contaminants from the plug; and wherein the first separation zone is fluidly connected with a dielectric fluid reservoir containing a dielectric fluid so that a dielectric fluid pressure in the first separation zone is regulated in relation to an ambient wellbore fluid pressure.

14. The downhole electrical wet connection system of claim 13, further comprising a pressure regulating piston disposed in the dielectric fluid reservoir.

15. The downhole electrical wet connection system of claim 13, wherein the second electrical contact is disposed between the first series of wiper seals and a second series of wiper seals.

16. The downhole electrical wet connection system of claim 15, the second series of wiper seals spaced apart by a second separation zone, the second separation zone fluidly connected with a second dielectric fluid reservoir.

17. The downhole electrical wet connection system of claim 16, wherein the first separation zone and the second separation zone are maintained at an equal dielectric fluid pressure during the insertion of the plug from the socket.

18. The downhole electrical wet connection system of claim 16, wherein the plug adapted to travel through the second separation zone as the second series of wiper seals wipe contaminants from the plug.

19. The downhole electrical wet connection system of claim 13, wherein the first series of wiper seals comprises at least three wiper seals separated at least two separation zones.

20. The method of making a downhole electrical wet connection comprising:

slidingly inserting a plug into a socket;

wherein the socket comprises a first series of wiper seals spaced apart by a first separation zone;

removing contaminants from the plug as the plug travels through first series of wiper seals and the first separation zone during the inserting;

wherein the first separation zone is supplied with a dielectric fluid at a dielectric fluid pressure from a dielectric fluid reservoir; and regulating the dielectric fluid pressure in the first separation zone relative to an ambient fluid pressure.

* * * * *